US006440279B1

(12) United States Patent
De Capite et al.

(10) Patent No.: US 6,440,279 B1
(45) Date of Patent: Aug. 27, 2002

(54) CHEMICAL MILLING PROCESS FOR INERT ANODES

(75) Inventors: Dennis R. De Capite, Leechburg; Gary P. Tarcy, Murrysville, both of PA (US); Susanne M. Opalka, Glastonbury, CT (US); Don R. Careatti, Alcoa Center, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/750,392

(22) Filed: Dec. 28, 2000

(51) Int. Cl.[7] ..... B01D 59/50; C25C 3/06; C25C 5/04

(52) U.S. Cl. ..... 204/247.3; 204/243.1; 204/292; 205/385; 205/386; 205/387; 205/372; 205/538; 205/543; 205/544; 205/545; 423/593; 423/594; 423/595; 423/600; 264/104

(58) Field of Search ..... 205/362, 354, 205/357, 483, 485, 538, 543, 544, 545, 387, 372, 385, 386; 204/243.1, 247.3, 291, 292, 293; 148/679; 420/469, 497, 501, 502, 503; 423/593, 594, 595, 600

(56) References Cited

U.S. PATENT DOCUMENTS

| | | | | |
|---|---|---|---|---|
| 2,092,130 A | | 9/1937 | Lyons | 204/1 |
| 2,115,005 A | | 4/1938 | Blaut et al. | 204/1 |
| 3,841,983 A | | 10/1974 | Itai et al. | 204/146 |
| 4,374,050 A | | 2/1983 | Ray | 252/519 |
| 4,374,761 A | | 2/1983 | Ray | 252/519 |
| 4,399,088 A | | 8/1983 | Greene | 264/54 |
| 4,455,211 A | | 6/1984 | Ray et al. | 204/293 |
| 4,582,585 A | | 4/1986 | Ray | 204/243 R |
| 4,584,172 A | | 4/1986 | Ray et al. | 419/34 |
| 4,620,905 A | | 11/1986 | Tarcy et al. | 204/64 R |
| 5,279,715 A | | 1/1994 | La Camera et al. | 204/64 R |
| 5,794,112 A | | 8/1998 | Ray et al. | 419/21 |
| 5,865,980 A | | 2/1999 | Ray et al. | 205/367 |
| 6,030,518 A | * | 2/2000 | Dawless et al. | 205/387 |
| 6,126,799 A | | 10/2000 | Ray et al. | 204/291 |
| 6,162,334 A | | 12/2000 | Ray et al. | 204/290.14 |
| 6,332,969 B1 | * | 12/2001 | Ray et al. | 205/362 |

* cited by examiner

*Primary Examiner*—Bruce F. Bell
(74) *Attorney, Agent, or Firm*—Diane R. Meyers; Glenn E. Klepac

(57) ABSTRACT

A cermet inert anode having a reduced level of contaminating surface metal is disclosed. Methods for preparing cermet inert anodes and methods for treating cermet inert anodes are also disclosed. The methods generally use an oxidizing agent to convert metals on the surface of the anode to inert oxides and/or to otherwise remove the metal contaminants. The inert anodes of the present invention may be used in electrolytic reduction cells for the production of commercial purity aluminum, as well as other metals.

46 Claims, 1 Drawing Sheet

CHEMICAL MILLING PROCESS FOR INERT ANODES

FIELD OF THE INVENTION

The present invention relates to the electrolytic production of metals, such as aluminum. More particularly, the invention relates to electrolysis in a cell having a cermet inert anode comprising a ceramic phase and a metal phase, wherein the anode has been subjected to a chemical milling process.

BACKGROUND OF THE INVENTION

The energy and cost efficiency of aluminum smelting can be significantly reduced with the use of inert, non-consumable, and dimensionally stable anodes. Replacement of traditional carbon anodes with inert anodes allows a highly productive cell design to be utilized, thereby reducing capital costs. Significant environmental benefits are also possible because inert anodes produce essentially no $CO_2$ or $CF_4$ emissions. Some examples of inert anode compositions are provided in U.S. Pat. Nos. 4,374,050; 4,374,761; 4,399,088; 4,455,211; 4,582,585; 4,584,172; 4,620,905; 5,279,715; 5,794,112; 5,865,980; and 6,126,799, and application Ser. No. 09/629,332 filed Aug. 1, 2000, assigned to Alcoa Inc. These patents and application are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, i.e., about 900 to 1,000° C., so that the voltage drop at the anode is low.

Although the use of inert anodes in aluminum electrolytic reduction cells has been proposed in the past, the use of such inert anodes has not been put into commercial practice. One reason for this lack of implementation has been the long-standing inability to produce aluminum of commercial-grade purity with inert anodes. For example, impurity levels of Fe, Cu, and/or Ni have been found to be unacceptably high in aluminum produced with known inert anode materials. Thus, in addition to the above-noted criteria, aluminum produced with inert anodes should not be contaminated with constituents of the anode material to any appreciable extent. The present invention has been developed in view of the foregoing.

SUMMARY OF THE INVENTION

Cermet inert anodes generally contain metals on their outer surfaces. The metals can be, for example, part of the metal phase of the anode, or metals that have bled to the surface of the anode during the sintering step of their production. These metals dissolve in the Hall bath during electrolysis and end up as impurities in the aluminum or other metal being produced. The present invention provides a cermet inert anode that has been chemically milled to reduce, if not eliminate, the presence of contaminating metals on the surface of the anode. Reduction or elimination of these contaminating surface metals results in an aluminum product that is of a commercial purity.

It is, therefore, an aspect of the present invention to provide a method for making a cermet inert anode, in which said anode is subjected to a chemical milling procedure that reduces, if not eliminates, contaminating metals from the surface of the anode. A further aspect of the invention is to provide the cermet inert anodes that result from this method, which anodes are suitable for use in a molten salt bath.

A further aspect of the invention is to provide an electrolytic cell for producing metal. The cell includes a molten salt bath comprising an electrolyte and an oxide of a metal to be collected, a cathode, and the cermet inert anodes of the present invention.

Another aspect of the invention is to provide a method for producing commercial purity aluminum, utilizing the cermet inert anodes of the present invention.

Other aspects and advantages of the invention will be apparent to those skilled in the art based upon the following detailed description and appended claims.

DESCRIPTION OF THE INVENTION

Figure 1:
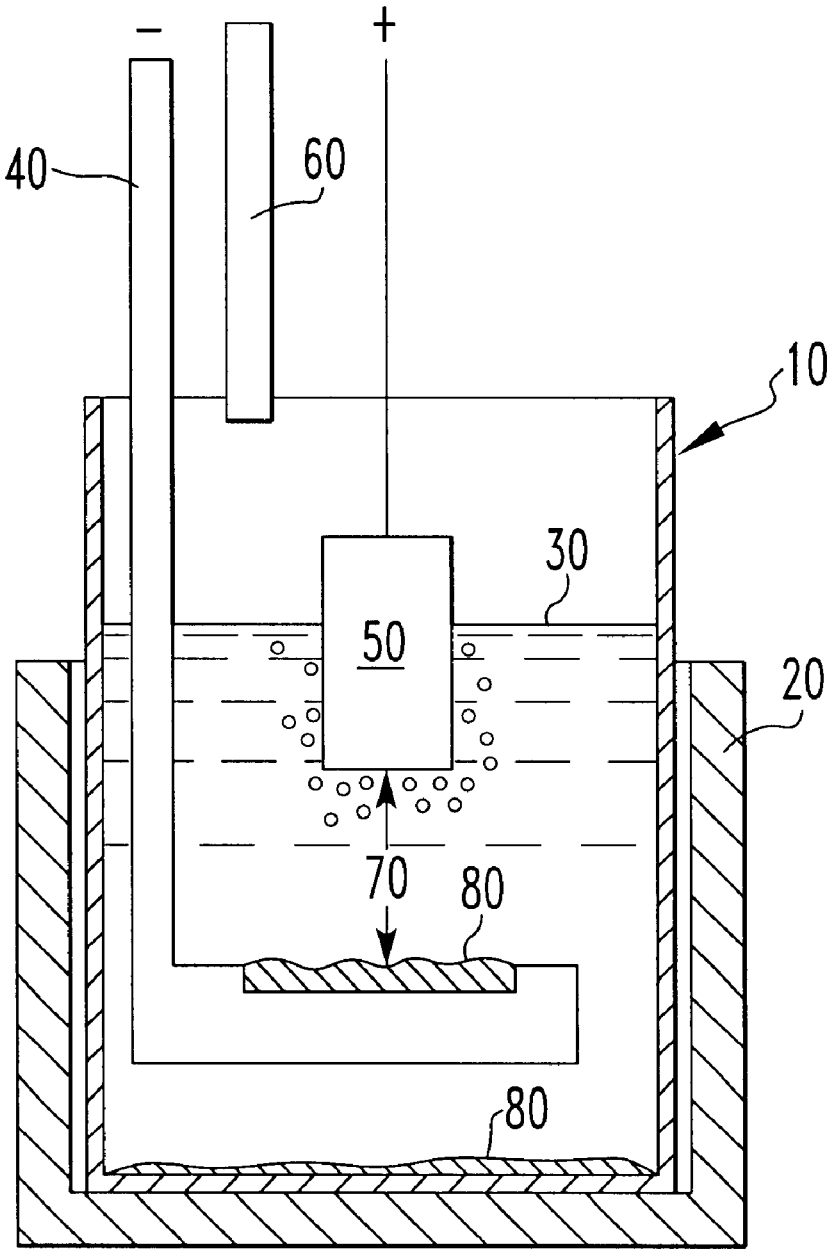
FIG. 1 is a partially schematic sectional view of an electrolytic cell for the production of metal including a cermet inert anode of one embodiment of the present invention.

The present invention is directed to a method for making a cermet inert anode comprising mixing a metal and/or a metal precursor material and a ceramic material; pressing the metal/metal precursor material and ceramic material mixture; sintering the mixture to form the cermet inert anode; and submerging the inert anode in an oxidizing agent at a temperature and for a time sufficient to minimize the level of contaminating metal on the surface of the inert anode. The method can further comprise the steps of policing the surface of the anode, rinsing the inert anode following submersion, and drying the inert anode at a temperature higher than room temperature.

As used herein, the term "inert anode" means a substantially non-consumable anode that possesses satisfactory corrosion resistance and stability during the metal production process. At least part of the inert anode comprises a cermet material; "cermet" as used in conjunction herein with "inert anode" will be recognized by one skilled in the art as referring to an anode having a ceramic phase and a metal phase. The inert anodes of the present invention may be made entirely of a cermet material, or may comprise an outer coating or layer of cermet material over a central core. Where the cermet is provided as an outer coating, it preferably has a thickness of between about 0.1 and 50 mm, more preferably between about 1 and 10 or 20 mm.

The cermet material of the present inert anodes typically comprises between about 1 and 99.9 wt. % of at least one ceramic phase and between about 0.1 and 99 wt. % of at least one metal phase. The ceramic phase preferably comprises from about 50 to about 95 wt. % of the cermet material, and the metal phase comprises between about 5 to about 50 wt. % of the cermet. More preferably, the ceramic phase comprises from about 80 to about 90 wt. % of the cermet, and the metal phase comprises from about 10 to about 20 wt. %.

The metal phase typically comprises from about 50 to about 99.99 wt. % of a base metal, and from about 0.01 to about 50 wt. % of a noble metal(s). Preferably, the metal phase comprises from about 70 to about 99.95 wt. % of the base metal, and from about 0.05 to about 30 wt. % of the noble metal(s). More preferably, the metal phase comprises from about 90 to about 99.9 wt. % of the base metal, and from about 0.1 to about 10 wt. % of the noble metal(s). It is noted that for every numerical range or limit set forth herein, all numbers within the range or limit including every fraction or decimal between its stated minimum and maximum are considered to be designated and disclosed by this description.

The ceramic phase of the present cermet inert anodes can be comprised of any suitable oxide materials, such as one or more of those selected from the group consisting of Ni, Fe, Zn, Co, Al, Li, Cu, Ti, V, Cr, Zr, Nb, Ta, W, Mo, Hf, Sn and any of the rare earth metal oxides. A preferred ceramic phase comprises iron and nickel oxides and at least one additional oxide from the list provided above. A particularly preferred ceramic phase embodiment comprises iron, nickel, and zinc oxides.

Similarly, any suitable metal phase can comprise that portion of the present cermet inert anodes. For example, the metal phase can be comprised of base metals, such as Cu and/or Ag that can be replaced in whole or part by, or mixed or alloyed with, one or more metals selected from Co, Ni, Fe, Al, Sn, Nb, Ta, Cr, Mo, W, and the like. The metal phase can also comprise a noble metal, such as one or more metals selected from Ag, Pd, Pt, Au, Rh, Ru, Ir, and Os. A preferred metal phase comprises a copper and/or silver base metal with the addition of Ag, Pd, Pt, Au, and/or Rh as the noble metal.

The metal phase may be continuous or discontinuous. When the metal phase is continuous, it forms an interconnected network or skeleton that may substantially increase the electrical conductivity of the cermet anode. When the metal phase is discontinuous, discreet particles of the metal are at least partially surrounded by the ceramic phase(s), which may increase corrosion resistance of the cermet anode.

The types and amounts of base and noble metals contained in the metal phase of the present inert anodes are selected in order to substantially prevent unwanted corrosion, dissolution, or reaction of the inert anodes, and to withstand the high temperatures to which the inert anodes are subjected during the electrolytic metal reduction process. For example, in the electrolytic production of aluminum, the production cell typically operates at a sustained smelting temperature above 800° C., usually at temperatures of about 900–980° C. Accordingly, inert anodes used in such cells should preferably have metal phase melting points above 800° C., more preferably, above 900° C., and optimally, above about 1,000° C.

Suitable materials for the ceramic and metal phases of the present inert anodes, the ratios of metals, and the like are provided, for example, in U.S. application Ser. No. 09/629,332, filed Aug. 1, 2000, which is hereby incorporated by reference. As described therein, a particularly preferred ceramic phase material has the formula $Ni_xFe_{2y}M_zO_{(3y+x+z)\pm\delta}$. M is at least one metal selected from Zn, Co, Al, Li, Cu, Ti, V, Cr, Zr, Nb, Ta, W, Mb, Hf and rare earths; "x" is between about 0.1 to about 0.99, preferably 0.45 and 0.8, more preferably 0.45 and 0.65; "y" is between about 0.0001 and 0.9, preferably 0.05 and 0.499, more preferably 0.2 and 0.49; "z" is between about 0.0001 to about 0.5, preferably 0.001 and 0.26, more preferably 0.001 and 0.22, most preferably 0.05 and 0.30; and "δ" is between 0 and about 0.3.

As discussed above, the present method involves mixing a metal material and a ceramic material. Any suitable means can be used to provide a substantially uniform metal/ceramic mixture. For example, the ceramic and metal materials can be blended in a mixer.

In addition to the ceramic and metal portions, the mixture for making the inert anodes can also comprise an organic polymeric binder, plasticizer and/or dispersant; such components are added in an amount of between 0.1 to 10 parts by weight per 100 parts by weight of the ceramic and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 0.3 to 6 parts by weight of the binder or other components are added to 100 parts by weight of the ceramic and metal mixture.

The blended ceramic and metal powders may be sent to a press where they are isostatically pressed, for example at 10,000 to 40,000 psi, into anode shapes. A pressure of about 2,000 psi is particularly suitable for many applications.

The pressed shapes may then be sintered in a controlled atmosphere furnace supplied with an argon-oxygen gas mixture, a nitrogen-oxygen gas mixture, or other suitable gas mixtures. Sintering temperatures of between about 1,000 and 1,400° C. are typically suitable. The furnace is typically operated at between about 1,350 and 1,385° C. for two to four hours. If a polymeric binder is used, the sintering process will burn out any of the binder from the anode shapes.

The gas supplied during sintering preferably contains about 5–3,000 ppm oxygen, more preferably about 5–700 ppm oxygen and most preferably about 10–350 ppm oxygen. Lesser concentrations of oxygen can result in a product having a larger metal phase than desired, and excessive oxygen can result in a product having too much of a ceramic phase. The remainder of the gaseous atmosphere preferably comprises a gas such as argon that is inert to the metal at the reaction temperature.

Sintering anode compositions in an atmosphere of controlled oxygen content typically lowers the porosity to acceptable levels and avoids the bleed out of the metal phase. The atmosphere may be predominantly argon, with controlled oxygen contents in the range of 17–350 ppm. The anodes may be sintered in a tube furnace at 1,350° C. for two hours. Anode compositions sintered under these conditions typically have less than 0.5% porosity when the compositions are sintered in argon containing between about 70 and 150 ppm oxygen.

While the present conditions are selected to minimize the bleed out of the metal phase, it will be appreciated that some degree of bleeding can occur and will result in loose metal being present on the outside of the anode. In addition, some portion of the metal material used to form the metal phase will be present on the anode surface. The presence of this metal can result in the contamination of the electrolytically produced metal; this contamination can be quite bad and can occur very quickly. "Contaminating metal" as used herein refers to metal on the surface of the inert anode such as the metal that has bled out of the anode during sintering, the metal used for the metal portion of the cermet anode, or metal that finds its way to the surface through any other means.

The present invention provides for minimizing the level of contaminating metal from the surface of the anode by submerging the anode into an oxidizing agent. The term "oxidizing agent" as used herein refers to a composition or solution that has enough oxidizing power to oxidize the metal on the surface of the anode, and that is acidic enough to maintain the oxidized metals in solution; it will be appreciated that if the oxidizing agent is not of a suitably acidic pH, the dissolved metal ions will precipitate on the anode surface as insoluble hydroxides. Suitable oxidizing agents include, for example, nitric acid, perchloric acid, sodium hypochlorite, ammonium persulfate, hydrogen peroxide, potassium dichromate, potassium permanganate, and the like, in solution. A particularly suitable oxidizing agent is a one-to-one solution of water and concentrated nitric acid.

The oxidizing agent serves to minimize contaminating metal levels in at least two ways, although the inventors do not wish to be bound by any particular mechanism. The surface metal that exists as part of the metal phase of the cermet can react with the oxidizing agent and be "converted" to a metal oxide or other inert compound that will not degrade in the electrolytic bath; a metal oxide or other inert compound is therefore far less contaminating to an electrolytic bath than is a metal alone. Alternatively, the bled metal can be oxidized by the oxidizing agent and removed from the anode surface. "Minimizing" contaminating metals on the anode surface refers to these various oxidation reactions in which metal is converted to its oxide or otherwise oxidized and removed from the anode surface. Any amount of oxidization is within the scope of the present invention and can include complete conversion and/or removal of contaminating metal or anything less than complete.

A chelating agent can also be used in conjunction with the oxidizing agent. Examples include sodium citrate and ethylenediamine tetraacetic acid (EDTA). The chelating agent binds to the dissolved metal keeping it in solution and thereby preventing or at least minimizing the precipitation of the metal as the hydroxide. A 0.5% chelating agent solution can be added to the oxidizing agent solution.

The inert anode should be treated with the oxidizing agent at a temperature and for a time sufficient to effect the desired amount of minimization of the levels of contaminating metal from the surface of the anode. Typically, the temperature should be high enough to aid in the oxidation of the base metals on the surface of the anode without causing degradation of the ceramic oxide structure of the anode. Typically, the oxidizing agent is maintained at a temperature of between about 15 and 120° C., more preferably between about 90 and 95° C.

Similarly, the time of contact should be sufficient so as to effect the desired level of oxidation of surface metals, without resulting in attack of the ceramic material. Typically, the inert anode can be submerged in the oxidizing agent for a period of between about 1 minute and 24 hours, more preferably about 5–30 minutes.

Treatment is preferably effected by submersion of the anode. Submersion can be complete or partial, based upon the needs and desires of the user.

The surface of the inert anode can be policed, for example, with a rubber spatula or other nonabrasive object. Policing of the surface of the anode aids in removing loose, unwanted debris that adheres to the surface even after being exposed to the oxidizing agent. A policing step can be performed during submersion, and can be repeated as desired by the user.

Following submersion of the anode in the oxidizing agent, the anode can then be rinsed, such as in deionized water. The rinsed anode can then be dried at temperatures above room temperature, such as in a furnace set to between about 70 and 200°. Typically, a temperature of 110° C. is sufficient to effect suitable drying of the anode.

The present invention is further directed to a method for treating a cermet inert anode by submerging the inert anode in an oxidizing agent at a temperature and for a time sufficient to minimize the level of contaminating metal on the surface of the anode. The oxidizing agent, time and temperature for submersion are as described above. Again, the policing, rinsing and drying steps as described above can also be employed. Minimizing contaminating metal from the anode surface refers to any amount of conversion or removal of the surface metal effected by the oxidizing agent. Any amount of "minimization" is within the present invention, although it will be appreciated that the greater the conversion/removal of surface metal, the lower the contamination of the final metal product. Those metal particles remaining on or near the surface of the anode after treatment according to the present methods will typically be difficult to dissolve and should not pose a significant contamination risk to the metal being produced by the electrolytic process.

Any cermet anode having metal on or near its surface can be treated as described herein. For example, anodes treated according to the present methods can be those described above or in co-pending U.S. application Ser. No. 09/629,332, or those described in U.S. Pat. Nos. 4,374,050; 4,374,761; 4,399,008; 4,454,015; 4,455,211; 4,478,693; 4,620,905; 5,279,715; 5,794,112; 5,865,980; and 6,126,799. Other cermet based anodes known to those skilled in the art or developed in the future can also be treated according to the present methods.

The cermet inert anodes treated according to the present invention may be formed by ceramic fabrication procedures well known to those skilled in the art. Such techniques include, for example, powder sintering, discussed above, sol-gel processes, slip casting and spray forming. Preferably, the inert anodes are formed by powder techniques in which powders comprising the ceramic and metal phases are pressed and sintered. The powder sintering method is discussed above, and can further include blending the ceramic powders in a mixer prior to combining them with metal material powders. Optionally, the blended ceramic powders may be ground to a smaller size before being transferred to a furnace where they are calcined, for example, for twelve hours at 1,250° C. The calcination produces a mixture made from various oxide phases. The oxide mixture may also be sent to a ball mill where it is ground to an average particle size of approximately 10 microns. The fine oxide particles can be blended with a polymeric binder and water to make a slurry in a spray dryer. The slurry contains, for example, about 60 wt. % solids and about 40 wt. % water. Spray drying the slurry produces dry agglomerates of the oxides that may be transferred to a V-blender and mixed with metal powders. Alternatively, the oxide and metal constituents may be spray-dried together. The metal material powders may comprise substantially pure metals such as Cu and Ag and alloys thereof, or may comprise oxides of base metals and/or noble metals such as AgO, CuO or $Cu_2O$.

The present invention is also directed to ceramic inert anodes that have been treated according to the present invention. Such anodes, as described above, comprise a ceramic phase and a metal phase. The anodes will typically have a reduced level of surface metals as compared with anodes produced in similar fashion that have not been treated with an oxidizing agent according to the present methods. The inert anodes of the invention are: useful in producing metal such as aluminum, lead, magnesium, zinc, zirconium, titanium, lithium, calcium, silicon and the like, generally by electrolytic reduction of an oxide or other salt of the metal. The present inert anodes are particularly useful in electrolytic salts for aluminum production operated at temperatures in the range of between about 800 and 1,000° C. A particularly preferred cell operates at a temperature of 900 to 980° C., more preferably about 930 to 970° C. An electric current is passed between the inert anode and a cathode through a molten salt bath comprising an electrolyte and an oxide of the-metal to be collected. In a preferred cell for aluminum production, the electrolyte comprises aluminum fluoride and sodium fluoride and the metal oxide and alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

The present invention is therefore further directed to an electrolytic cell for producing metal comprising a molten salt bath comprising an electrolyte and an oxide of a metal to be collected; a cathode; and a cermet inert anode prepared or treated according to the present invention. FIG. 1 schematically illustrates an electrolytic cell for the production of aluminum which includes a cermet inert anode in accordance with an embodiment of the present invention. The cell includes an inner crucible 10 inside a protection crucible 20. A cryolite bath 30 is contained in the inner crucible 10, and a cathode 40 is provided in the bath 30. A cermet inert anode 50 is positioned in the bath 30. An alumina feed tube 60 extends partially into the inner crucible 10 above the bath 30. The cathode 40 and inert anode 50 are separated by a distance 70 known as the anode-cathode distance (ACD). Aluminum 80 produced during a run is deposited on the cathode 40 and on the bottom of the crucible 10. In addition to the production of aluminum, the cermet inert anodes of the invention may also be useful in producing other metals such as lead, magnesium, zinc, zirconium, titanium, lithium, calcium, silicon, barium, strontium, scandium, niobium, vanadium, tantalum, tin, germanium, indium, hafnium, molybdenum and the like, by electrolytic reduction of an oxide or other salt of the metal.

As noted above, the inert anodes prepared according to the present invention are particularly suitable for the production of a substantially uncontaminated metal product, especially the production of aluminum, more specifically commercial purity aluminum. The term "commercial purity" as used in conjunction with aluminum herein refers to aluminum that meets commercial purity standards upon production by an electrolytic reduction process. The commercial purity aluminum produced with the present inert anodes preferably comprises a maximum of 0.2 wt. % Fe, 0.1 wt. % Cu, and 0.034 wt. % Ni. In a more preferred embodiment, the commercial purity aluminum comprises a maximum of 0.15 wt. % Fe, 0.034 wt. % Cu, and 0.03 wt. % Ni. In a particularly preferred embodiment, the commercial purity aluminum comprises a maximum of 0.13 wt. % Fe, 0.03 wt. % Cu, and 0.03 wt. % Ni. The commercial purity aluminum also preferably meets the following weight percentage standards for other types of impurities: 0.2 maximum Si, 0.03 maximum Zn, and 0.034 maximum Co. The Zn and Co impurity levels are more preferably kept below 0.03 wt. % each. The Si impurity level is more preferably kept below 0.15 or 0.10 wt. %.

Accordingly, the present invention is further directed to a method of producing commercial purity aluminum comprising passing current between the cermet inert anode of the present invention and a cathode through a bath comprising an electrolyte and aluminum oxide and recovering aluminum therefrom. Preferably, the aluminum has the maximum impurity levels recited above.

The present invention therefore provides advantageous methods to prepare cermet inert anodes, and the anodes produced thereby. The novel methods of the present invention cause a reaction with contaminating surface metals of the anodes only, without attacking the ceramic portion of the anode or effecting the metal portion of the anode underneath the surface. The electrolytic bath is therefore less able to penetrate/infiltrate the cermet inert anode. As a result, lower levels of contamination are achieved when the present anodes are used in the electrolytic production of metal.

EXAMPLES

The following examples are intended to illustrate the invention and should not be construed as limiting the invention in any way.

Example 1

An inert anode was treated according to the present methods. A solution of concentrated $HNO_3$ and water in a 1:1 ratio was heated to approximately 90° C. 1,200 mls of the solution were poured into a cup-shaped cermet anode comprising 83 wt. % of a nickel ferrite ceramic phase and 17 wt. % of a metal phase comprising copper and silver metal; the surface was policed. The solution turned blue within a period of about one minute, indicating that copper was being dissolved in the solution. The solution was kept in the anode overnight. The following morning, the anode was rinsed out. The surface of the anode was smooth, as if a chemical milling process had been applied. A second hot wash of the 50% $HNO_3$ solution was then applied to the anode; this surface was policed and left in contact with the solution for approximately 45 minutes. Following that time, the resulting solution was clear. The anode was rinsed with deionized water and placed in a drying oven.

This chemical milled anode was used in a Hall cell that was run for 20 hours. The main objective was to see if the chemical milled anode produced higher purity aluminum. The results for the chemical milled anode are listed in Table 1 below and are compared to a separate 20-hour run that did not use a chemical milled anode. As can be seen from the results in Table 1, the chemical milled anode produced significantly better quality as evidenced by the lower impurity levels than did the non-chemical milled anode.

TABLE 1

| | Metal Purity (% contain impurity) | | | |
|---|---|---|---|---|
| | % Fe | % Cu | % Ni | % Ag |
| Chemical milled | 0.18 | 0.47 | 0.061 | 0.21 |
| Not chemical milled | 0.42 | 1.6 | 0.23 | 0.61 |

Example 2

Anode comprising 83 wt. % of a nickel ferrite ceramic phase and 17 wt. % of a copper, silver metal phase was cut into one-half inch wide sections from the sidewall to the bottom. A 50% $HNO_3$ solution, prepared as described in Example 1, was heated to 95° C., as was a water bath. One piece of anode was each placed in a 30 ml plastic tube. Approximately 45 ml of the hot nitric acid solution was added to the tube, the top was screwed onto the tube, and the tube placed in the water bath. One piece was kept as a control, using water instead of the nitric acid solution. One anode piece was removed from one of the tubes every 30 minutes, and rinsed with deionized water. The etch rate was determined for each of the samples. In addition to the nitric acid bath, one of the samples was placed in a solution of 20% ammonium persulfate at 95° C. for 30 minutes. Each rate determinations are provided in Table 2.

TABLE 2

| | Fe (mg) | Cu (mg) | Ni (mg) | Ag (mg) |
|---|---|---|---|---|
| $NH_4$ persulfate | 27 | 239 | 84 | 3.0 |
| 30 min $HNO_3$ | 11 | 481 | 126 | 50 |
| 60 | 17 | 277 | 111 | 35 |
| 90 | 23 | 580 | 166 | 66 |
| 120 | 26 | 573 | 177 | 69 |
| 150 | 38 | 636 | 199 | 69 |
| 180 | 33 | 492 | 165 | 58 |
| 210 | 30 | 456 | 162 | 54 |
| 240 | 31 | 500 | 155 | 60 |
| 270 | 42 | 440 | 166 | 53 |
| 300 | 41 | 643 | 192 | 71 |

As can be seen from the above table, the longer the exposure time, the more erosion of the anode occurs. The greatest amount of etching occurs prior to 90 minutes. Micrographs of the pieces (not pictured) showed that the etch time of 30 minutes was the best time, due to less penetration into the ceramic phase.

Whereas particular embodiments of this invention have been described above for purposes of illustration, it will be evident to those skilled in the art that numerous variations of the details of the present invention may be made without departing from the invention as defined in the appended claims.

What is claimed is:

1. A method of making a cermet inert anode, the method comprising:

(a) mixing a metal and a ceramic material to form a mixture;

(b) pressing the mixture of step a);

(c) sintering the mixture of step b) to form a cermet inert anode comprising a metal phase and a ceramic phase and having an outer surface portion; and (d) treating said outer surface portion with an oxidizing agent at a temperature and for a time sufficient to minimize levels of contaminating metal on said outer surface portion of said anode.

2. The method of claim 1, wherein said treating step is effected by partially submerging said anode in said oxidizing agent.

3. The method of claim 1, wherein said treating step is effected by completely submerging said anode in said oxidizing agent.

4. The method of claim 1, further comprising the step of e) rinsing the anode of step d).

5. The method of claim 4, wherein said rinsing is effected with deionized water.

6. The method of claim 4, further comprising the step of f) drying the rinsed anode in a drying oven.

7. The method of claim 6, wherein drying is effected at a temperature of between about 70 and 200° C.

8. The method of claim 7, wherein drying is effected at a temperature of about 110° C.

9. The method of claim 1, wherein said oxidizing agent is selected from the group consisting of nitric acid, perchloric acid, sodium hypochlorite, ammonium persulfate, hydrogen peroxide, potassium dichromate, and potassium permanganate.

10. The method of claim 9, wherein the oxidizing agent is a nitric acid solution.

11. The method of claim 1, wherein said temperature of step d) is between about 15 and 120° C.

12. The method of claim 11, wherein said temperature of step d) is between about 90 and 95° C.

13. The method of claim 1, wherein said time of step d) is between about 1 minute and 24 hours.

14. The method of claim 13, wherein said time of step d) is between about 5 and 30 minutes.

15. The method of claim 1, further comprising policing said outer surface portion of said anode during step d).

16. The cermet inert anode prepared by any one of the methods of claims 1–15.

17. An electrolytic cell for producing metal comprising:

(a) a molten salt bath comprising an electrolyte and an oxide of a metal to be collected;

(b) a cathode; and (c) a cermet inert anode made according to any one of claims 1–15.

18. A method of producing commercial purity aluminum comprising:

(a) passing current between a cermet inert anode and a cathode through a bath comprising an electrolyte and aluminum oxide; and (b) recovering aluminum comprising a maximum of 0.20 weight percent Fe, 0.1 weight percent Cu, and 0.034 weight percent Ni; wherein the cermet inert anode is made according to any one of claims 1–15.

19. The method of claim 18, wherein the recovered aluminum comprises a maximum of 0.15 weight percent Fe, 0.034 weight percent Cu, and 0.03 weight percent Ni.

20. The method of claim 18, wherein the recovered aluminum comprises a maximum of 0.13 weight percent Fe, 0.03 weight percent Cu, and 0.03 weight percent Ni.

21. The method of claim 18, wherein the recovered aluminum further comprises a maximum of 0.2 weight percent Si, 0.03 weight percent Zn, and 0.03 weight percent Co.

22. The method of claim 1, wherein said oxidizing agent further comprises a chelating agent.

23. The method of claim 22, wherein said chelating agent is selected from the group consisting of sodium citrate and ethylenediamine tetraacetic acid (EDTA).

24. A method for treating a cermet inert anode comprising submerging the anode in an oxidizing agent at a temperature and for a time sufficient to minimize the level of contaminating metal on the surface of said anode.

25. The method of claim 24, wherein said oxidizing agent is selected from the group consisting of nitric acid, perchloric acid, sodium hypochlorite, ammonium persulfate, hydrogen peroxide, potassium dichromate, and potassium permanganate.

26. The method of claim 25, wherein said oxidizing agent is a solution of nitric acid.

27. The method of claim 24, wherein said anode is partially submerged in said oxidizing agent.

28. The method of claim 24, wherein said anode is completely submerged in said oxidizing agent.

29. The method of claim 24, wherein said temperature is between about 15 and 120° C.

30. The method of claim 29, wherein said temperature is between about 90 and 95° C.

31. The method of claim 24, wherein said time is between about 1 minute and 24 hours.

32. The method of claim 31, wherein said time is between about 5 and 30 minutes.

33. The method of claim 24, further comprising the step of rinsing the inert anode.

34. The method of claim 33, wherein said rinsing is effected with deionized water.

35. The method of claim 33, further comprising the step of drying the rinsed inert anode in a drying oven.

36. The method of claim 35, wherein said drying is effected at a temperature of between 70 and 200° C.

37. The method of claim 36, wherein said drying is effected at a temperature of about 110° C.

38. The method of claim 24, further comprising policing the surface of the anode during submersion.

39. The inert anode prepared according to the method of any one of claims 24–38.

40. An electrolytic cell for producing metal comprising:

(a) a molten salt bath comprising an electrolyte and an oxide of a metal to be collected;

(b) a cathode; and (c) a cermet inert anode treated according to any one of claims 24–38.

41. A method of producing commercial purity aluminum comprising:

(a) passing current between a cermet inert anode and a cathode through a bath comprising an electrolyte and aluminum oxide; and (b) recovering aluminum comprising a maximum of 0.20 weight percent Fe, 0.1 weight percent Cu, and 0.034 weight percent Ni; wherein the cermet inert anode is treated according to any one of claims 24–38.

42. The method of claim 41, wherein the recovered aluminum comprises a maximum of 0.15 weight percent Fe, 0.034 weight percent Cu, and 0.03 weight percent Ni.

43. The method of claim 41, wherein the recovered aluminum comprises a maximum of 0.13 weight percent Fe, 0.03 weight percent Cu, and 0.03 weight percent Ni.

44. The method of claim 41, wherein the recovered aluminum further comprises a maximum of 0.2 weight percent Si, 0.03 weight percent Zn, and 0.03 weight percent Co.

45. The method of claim 24, wherein said oxidizing agent further comprises a chelating agent.

46. The method of claim 45, wherein said chelating agent is selected from the group consisting of sodium citrate and ethylenediamine tetraacetic acid (EDTA).

* * * * *